US012084845B2

(12) United States Patent
Denham

(10) Patent No.: US 12,084,845 B2
(45) Date of Patent: Sep. 10, 2024

(54) OUTLET APERTURE ARRANGEMENTS

(71) Applicant: FLUSHECO LIMITED, Redditch (GB)

(72) Inventor: Stuart Denham, Warwickshire (GB)

(73) Assignee: Flusheco Limited, Redditch (GB)

( * ) Notice: Subject to any disclaimer, the term of this patent is extended or adjusted under 35 U.S.C. 154(b) by 464 days.

(21) Appl. No.: 17/904,896

(22) PCT Filed: Feb. 25, 2020

(86) PCT No.: PCT/EP2020/054952
§ 371 (c)(1),
(2) Date: Aug. 24, 2022

(87) PCT Pub. No.: WO2020/173969
PCT Pub. Date: Sep. 3, 2020

(65) Prior Publication Data

US 2023/0131955 A1 Apr. 27, 2023

(30) Foreign Application Priority Data

Feb. 25, 2019 (GB) ..... 1902535

(51) Int. Cl.
*E03C 1/02* (2006.01)
*E03D 1/38* (2006.01)

(52) U.S. Cl.
CPC ..... *E03C 1/023* (2013.01); *E03D 1/38* (2013.01)

(58) Field of Classification Search
CPC ... E03D 9/16; E03C 1/02; E03C 1/023; E03C 1/38
USPC ..... 137/561 A; 138/37
See application file for complete search history.

(56) References Cited

U.S. PATENT DOCUMENTS

| | | | | |
|---|---|---|---|---|
| 1,110,715 | A * | 9/1914 | Reese | E03C 1/306 4/255.09 |
| 1,140,252 | A * | 5/1915 | Clark | E03D 1/38 137/433 |
| 2,100,389 | A * | 11/1937 | Gavin | E03D 9/16 4/300 |
| 5,709,468 | A * | 1/1998 | Woerheide | F22B 37/227 137/561 A |
| 10,578,217 | B2 * | 3/2020 | Schulte | E03D 5/012 |
| 2014/0182718 | A1 * | 7/2014 | Wolfcarius | F01N 13/08 137/561 A |
| 2014/0360919 | A1 * | 12/2014 | Le Coz | B01D 3/007 137/561 A |

(Continued)

FOREIGN PATENT DOCUMENTS

| | | | |
|---|---|---|---|
| CN | 107724484 | A | 2/2018 |
| DE | 2252965 | A1 | 5/1973 |
| EP | 3276095 | A1 | 1/2018 |

*Primary Examiner* — Umashankar Venkatesan
(74) *Attorney, Agent, or Firm* — Keusey & Associates, P.C.

(57) ABSTRACT

An outlet aperture arrangement (100) includes a flow promotion device (10) which, in use, is located at an outlet aperture (12) defined by a liquid container (14), for example, a toilet cistern. The device (10) includes a divider arrangement (16). The divider arrangement (16) includes one or more divider members (18). In use, the divider arrangement (16) is located at or in an entrance (20) to the outlet aperture (12), so that the or each divider member (18) divides the entrance (20) into a plurality of outlet entrance parts (22).

20 Claims, 3 Drawing Sheets

(56) References Cited

U.S. PATENT DOCUMENTS

| | | | | |
|---|---|---|---|---|
| 2015/0047714 | A1* | 2/2015 | Doig | F16L 41/021<br>137/15.01 |
| 2016/0002903 | A1 | 1/2016 | Grover et al. | |
| 2018/0073231 | A1 | 3/2018 | Smith et al. | |

* cited by examiner

OUTLET APERTURE ARRANGEMENTS

BACKGROUND OF THE INVENTION

1. Field of the Invention

The present invention relates to outlet aperture arrangements, particularly but not exclusively outlet aperture arrangements for location at outlet apertures, of, for example, toilet cisterns.

2. The Prior Art

Conventionally, toilet flushing apparatus includes a cistern for storing water and a valve which is actuated by a user to release the stored water under gravity into a toilet pan. In other arrangements, the toilet flushing apparatus comprises a tiltably-mounted container, which is used to hold and release stored water into a cistern, from which the water flows to a toilet pan under gravity.

The flushing action of a toilet requires a certain volumetric flow rate to achieve an adequate flushing action. In recent years, a focus on reducing water usage has led to a reduction in the volume of flushing water used in toilets. To ensure that the flushing action is satisfactory, for example, in the UK, water supply regulations stipulate that the average volumetric flow rate for a full flush volume of no more than six litres should be at least 1.85 litres/s and for a reduced flush volume of no more than ⅔rds of the full flush volume the average volumetric flow rate should be at least 1.6 litres/s.

Investigations have shown that traditional high-level cisterns, or traditional cisterns which are connected to the toilet pan by an outlet pipe, can generally achieve the stipulated average flush flow rate. However, close-coupled cisterns, in which the cistern is located adjacent the toilet pan, often can fail to achieve the stipulated flow rate. This is thought to be due to the effect of a lower pressure head and hence reduced suction/siphonic effect provided by the smaller vertical distance between the cistern and the toilet pan.

Another problem for cisterns is that the toilet flushing action is a non steady state process in which the volume and hence pressure head of water steadily reduces over the time of the flush. As the amount of water in the cistern reduces, it is easier for vortices to form above an outlet aperture of the cistern, entraining air into the water flow and reducing the volumetric flow rate of water.

A further problem is that cisterns come in a variety of shapes and sizes. In some cases, the size of the cistern is constrained by having to fit into a designated space. In hydraulic terms, the outlet aperture of the cistern is usually close to one pair of side walls of the cistern and further away from another pair, which again acts to induce turbulence and vortices in the water flow.

While regulatory testing of valves can be carried out with a valve in a cistern of optimised shape and size, in real life conditions the performance of the toilet flushing apparatus may vary significantly from idealised test conditions and may be unsatisfactory.

In this specification, it will be understood that the term toilet refers to a lavatory or water closet. A toilet pan could also be referred to as a toilet bowl. A valve could also be referred to as a flush valve or flushing valve.

In this specification, the terms upward and downward and other similar orientation terms are used in relation to the in use orientation of a toilet cistern, in which upward means away from the ground and downward means towards the ground.

SUMMARY OF THE INVENTION

According to a first aspect of the present invention, there is provided an outlet aperture arrangement, the arrangement including a flow promotion device which in use is located at an outlet aperture defined by a liquid container, for example, a toilet cistern, the device including a divider arrangement, the divider arrangement including one or more divider members, wherein, in use, the divider arrangement is located at or in an entrance to the outlet aperture so that the or each divider member divides the entrance into a plurality of outlet entrance parts.

Possibly, each outlet entrance part comprises a horizontal flow cross sectional area. Possibly, the flow cross sectional areas of the outlet entrance parts are of substantially equally size.

Possibly, in use, the or each divider member extends into and through the outlet aperture and may extend downwardly into and through the outlet aperture. Possibly, the or each divider member comprises an insertion part which extends (possibly downwardly) into and through the outlet aperture.

Possibly, the or each divider member extends outwardly from the entrance, and may extend upwardly outwardly from the entrance. Possibly, the or each divider member includes an extension part which extends (possibly upwardly) outwardly from the entrance.

Possibly, the or one or some or all of the extension parts extend laterally outwardly beyond the outlet aperture.

Possibly, the or each divider member includes one insertion part and one extension part. Possibly, the or each divider member is substantially planar, and may be in the form of a plate.

Possibly, the divider arrangement includes a plurality of divider members, which may be joined together along a common joint, which may be in the form of a line, and could extend along a joint axis. Possibly, the aperture has an axis which may extend through a midpoint thereof and in use the joint axis may be coaxial with the aperture axis.

Possibly, the divider members extend from the common joint at a regular radial angle spacing.

Possibly, the divider arrangement comprises four divider members, and the regular radial angle spacing may be substantially 90°.

Possibly, the divider members are arranged in pairs, with the members of each pair being aligned with each other. Possibly, the pairs comprise a pair of first divider members and a pair of second divider members.

Possibly, in use, the insertion parts of each pair of divider members substantially form a diameter across the outlet aperture, and may extend substantially along the whole length of the diameter.

Possibly, the or each insertion part has a depth along the joint axis. Possibly, the or each extension part has a height along the joint axis. Possibly, the ratio of the insertion part depth to the extension part height is at least 2:1, and desirably may be at least 3:1. Possibly, the ratio of the insertion part depth to the extension part height is no more than 4.5:1 and desirably no more than 3.5:1.

Possibly, the outlet aperture is circular and has a radius.

Possibly, the ratio of the extension part height to the outlet aperture radius is at least 0.48:1, desirably may be at least 0.71:1 and optimally may be at least 0.81:1. Possibly, the ratio of the extension part height to the outlet aperture radius is no more than 1.24:1, desirably no more than 1.00:1 and optimally no more than 0.9:1.

Possibly, the or each extension part has a height of at least 10 mm, desirably at least 15 mm and optimally at least 17 mm. Possibly, the or each extension part has a height of no more than 26 mm, desirably no more than 21 mm and optimally no more than 19 mm.

Possibly, the or each insertion part has a width normal to the joint axis. Possibly, the or each extension part has a width normal to the joint axis.

Possibly, the ratio of the extension part width to the insertion part width is at least 2.11:1, desirably may be at least 2.58:1 and optimally may be at least 2.72:1. Possibly, the ratio of the extension part width to the insertion part width is no more than 3.51:1, desirably no more than 3.04:1 and optimally no more than 2.90:1.

Possibly, the device includes an end wall, which may be substantially solid, without any apertures, and may be supported by the or some or each of the extension parts. Possibly, the end wall extends substantially normally to the joint axis. Possibly, the end wall extends above, and possibly joined to the or some or each of the extension parts. Possibly, the end wall is rectangular in plan and may comprise a pair of substantially parallel first edges and a pair of substantially parallel second edges.

Possibly, the first end wall edges extend substantially in parallel with the first divider members.

Possibly, the or each of the extension parts extends substantially from the joint axis to substantially a midpoint of one of the end wall edges.

Possibly, the device includes a pair of substantially parallel side walls, each of which may be substantially solid, without any apertures. Possibly, the device includes only one pair of substantially parallel side walls. Possibly, the end wall extends between the side walls.

Possibly, each of the side walls is joined to a different one of the first edges. Possibly, the side walls extend substantially parallel to the first divider members.

Possibly, each side wall is substantially the same length as, and may extend substantially parallel to, the extension parts of the first divider members.

Possibly, the end wall, the side walls and the divider members define flow channels therebetween. Possibly, each of the flow channels has an inlet. Possibly, each of the flow channels has a vertical flow cross sectional area at a perimeter of the outlet aperture entrance. Possibly, each vertical flow cross sectional area is at least the size of the horizontal flow cross sectional area of the corresponding outlet entrance part and desirably is greater in size.

Possibly, in use, at the vertical flow cross sectional areas, the flow of fluid is substantially horizontal. Possibly, the flow channels are substantially the same or similar in size and shape.

Possibly, the flow channels extend laterally in pairs on two opposite sides of the joint axis. Possibly, the flow channels are aligned or in parallel with each other.

Possibly, the outlet aperture arrangement includes a connection arrangement for connecting the device to the cistern. Possibly, the connection arrangement defines the outlet aperture. Possibly, the connection arrangement defines a connection passage therethrough, which may communicate with the outlet aperture.

Possibly, in use, the divider arrangement extends through the outlet aperture and along the connection passage.

Possibly, the connection arrangement includes a pipe part and may include a flange part. Possibly, the flange part extends outwardly laterally from one end of the pipe part.

Possibly, the cistern includes a cistern wall which defines a cistern outlet aperture. Possibly, the cistern wall includes an internal surface.

Possibly, in use, the pipe part locates in and through the cistern outlet aperture. Possibly, in use, the flange part locates in sealing relationship against the internal surface of the cistern wall.

Possibly, the connection arrangement includes a seal to seal between the flange part and the internal surface of the cistern wall.

Possibly, the connection arrangement includes a clamp to clamp the flange part to the internal surface. Possibly, the clamp includes a threaded clamp ring. Possibly, the pipe part includes a threaded external surface. Possibly, the clamp ring is mounted on the pipe part threaded external surface, and may tighten against the cistern wall to clamp the flange part to the internal surface.

Possibly, the pipe part and the flange part of the connection arrangement are formed integrally and may be formed integrally with the device.

Possibly, the outlet aperture arrangement includes a mounting for a tiltably mounted container.

Possibly, the end wall defines a formation aperture. Possibly, the outlet aperture arrangement includes an aperture cover member, which in use locates in or over the formation aperture to substantially prevent or impede fluid flow therethrough.

Possibly, the outlet aperture arrangement is for use at an outlet aperture defined by a container. Possibly, the container is for containing liquid. Possibly, the outlet aperture is located so that during outflow of liquid from the container, the outlet aperture is and remains wholly submerged under the liquid, possibly substantially until the container is empty. Possibly, the outflow of liquid is under gravity.

Possibly, the outlet aperture entrance is substantially planar and horizontal.

Possibly, the outlet aperture arrangement is located in the container so that the depth of the liquid is substantially the same at each flow channel inlet.

Possibly, the outlet aperture is located in a lowermost part of a wall of the container, possibly a lowermost part of a base wall. Possibly, the overall direction of flow of the liquid though the outlet aperture during emptying is substantially vertical.

According to a second aspect of the present invention, there is provided a method of flushing a toilet, the method including providing an outlet aperture arrangement, the arrangement including a flow promotion device which in use is located at an outlet aperture defined by a liquid container, for example, a toilet cistern, the device including a divider arrangement, the divider arrangement including one or more divider members, wherein, in use, the divider arrangement is located at or in an entrance to the outlet aperture so that the or each divider member divides the entrance into a plurality of outlet entrance parts.

Possibly, the outlet aperture arrangement includes any of the features described in any of the preceding statements or following description. Possibly, the method includes any of the steps described in any of the preceding statements or following description.

BRIEF DESCRIPTION OF THE DRAWINGS

Embodiments of the present invention will now be described, by way of example only, and with reference to the accompanying drawings, in which.

Figure 2:
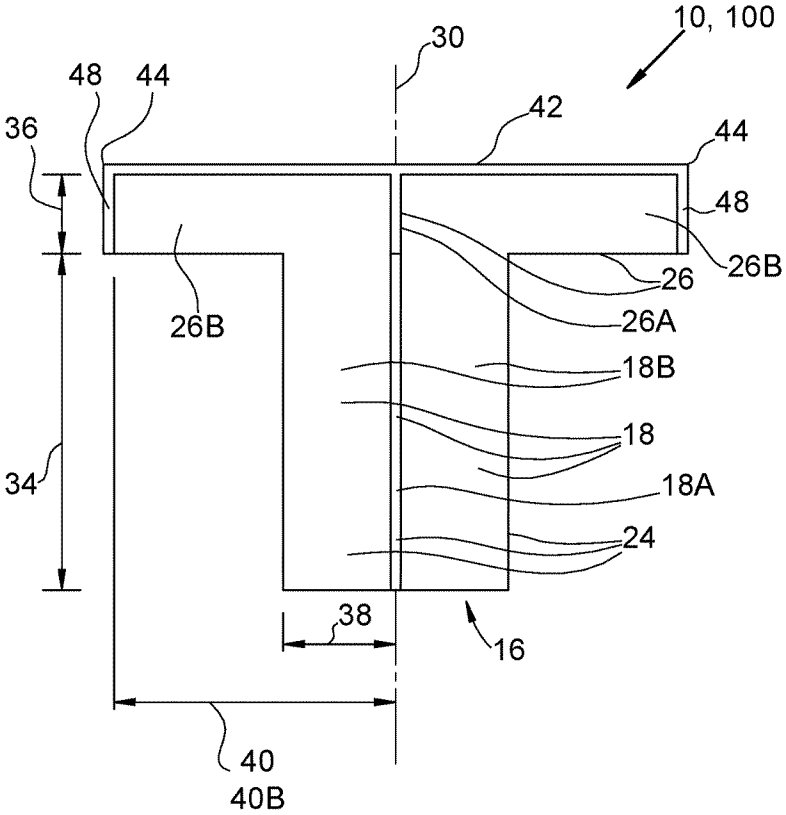
FIG. 2 is a side view of the device of FIG. 1.
Figure 1:
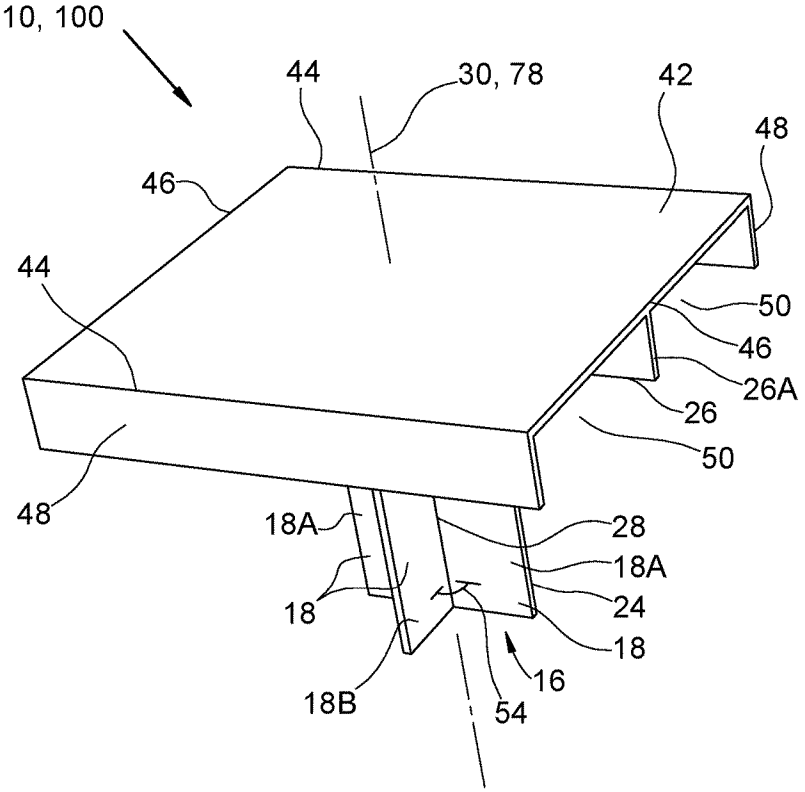
FIG. 1 is a perspective view of an outlet aperture arrangement comprising a flow promotion device.

In the drawings, where multiple instances of the same or similar features exist, only a representative one or some of the instances of the features have been provided with numeric references for clarity.

DETAILED DESCRIPTION OF THE PREFERRED EMBODIMENTS

FIGS. 1 to 3, 5 and 6 show an outlet aperture arrangement 100, the arrangement 100 including a flow promotion device 10 which, in use, is located at an outlet aperture 12 defined by a liquid container 14, for example, a toilet cistern. The device 10 includes a divider arrangement 16. The divider arrangement 16 includes one or more divider members 18. In use, the divider arrangement 16 is located at or in an entrance 20 to the outlet aperture 12, so that the or each divider member 18 divides the entrance 20 into a plurality of outlet entrance parts 22.

Each outlet entrance part 22 defines a horizontal flow cross sectional area 52H. In the example shown, the outlet aperture 12 is circular and has a radius 56, and the horizontal flow cross sectional areas 52H of the outlet entrance parts 22 are of substantially equally size.

In the example shown, the outlet aperture entrance 20 is substantially planar and horizontal.

In the example shown, the or each divider member 18 comprises one insertion part 24 which in use extends downwardly into and through the outlet aperture 12, and one extension part 26 which extends upwardly outwardly from the entrance 20.

Each of the extension parts 26 extends laterally outwardly beyond the outlet aperture 12. The or each divider member 18 is substantially planar, and could be in the form of a plate.

The divider arrangement 16 includes a plurality of divider members 18, which are joined together along a common joint 28, which could be in the form of a line, and extends along a joint axis 30. The outlet aperture 12 has an axis 32 which extends through a midpoint thereof and in use the joint axis 30 is coaxial with the aperture axis 32.

The divider members 18 could extend from the common joint 28 at a regular radial angle spacing 54.

In the example shown, the divider arrangement 16 comprises four divider members 18, and the regular radial angle spacing 54 is substantially 90°. The divider members 18 are arranged in pairs, comprising a pair of first divider members 18A and a pair of second divider members 18B, with the members of each pair 18A, 18B being aligned with each other.

Each insertion part has a width 38 normal to the joint axis 30. Each insertion part width 38 is approximately the same size as the outlet aperture radius 56.

Each insertion part 24 has a depth 34 along the joint axis 30 and each extension part 26 has a height 36 along the joint axis 30.

In one example, the ratio of the insertion part depth 34 to the extension part height 36 could be at least 2:1 and desirably might be at least 3:1. The ratio of the insertion part depth 34 to the extension part height 36 could be no more than 4.5:1, and desirably might be no more than 3.5:1.

In one example, each extension part 26 could have a height 36 of at least 10 mm, desirably at least 15 mm and optimally at least 17 mm. Each extension part 26 could have a height of no more than 26 mm, desirably no more than 21 mm and optimally no more than 19 mm.

Each extension part 26 has a width 40 normal to the joint axis 30.

In one example, the ratio of the extension part width 40 to the insertion part width 38 could be at least 2.11:1, desirably at least 2.58:1 and optimally at least 2.72:1. The ratio of the extension part width 40 to the insertion part width 38 could be no more than 3.51:1, desirably no more than 3.04:1 and optimally no more than 2.90:1.

The extension part widths 40 could be different for different divider members 18.

In one example, the widths 40A of the extension parts 26A of the first divider members 18A could be the same as each other, but could be different to the widths 40B of the extension parts 26B of the second divider members 18B. In one example, the widths 40A of the extension parts 26A of the first divider members 18A could be greater than the widths 40B of the extension parts 26B of the second divider members 18B.

In one example, the ratio of the extension part height 36 to the outlet aperture radius 56 could be at least 0.48:1, desirably at least 0.71:1 and optimally at least 0.81:1. The ratio of the extension part height 36 to the outlet aperture radius 56 could be no more than 1.24:1, desirably no more than 1.00:1 and optimally no more than 0.9:1.

The device 10 includes a divider member end wall 42, which is substantially solid, without any apertures, and is supported by the extension parts 26 of the divider members 18. The end wall 42 extends substantially normally to the joint axis 30, above and joined to the extension parts 26 of the divider members 18. The end wall 42 is rectangular in plan, and comprises a pair of substantially parallel first edges 44 and a pair of substantially parallel second edges 46.

The first end wall edges 44 extend substantially in parallel with the first divider members 18A.

In one example, the joint axis 30 is coaxial with an axis of symmetry 78 of the end wall 42 and each of the extension parts 26 extends substantially from the joint axis 30 to substantially a midpoint of one of the end wall edges 44, 46.

The device 10 includes a pair of substantially parallel side walls 48, each of which is substantially solid, without any apertures. In one example, the device 10 includes only one pair of substantially parallel side walls 48. The end wall 42 extends between the side walls 48.

Each of the side walls 48 is joined to a different one of the first edges 44.

Each side wall 48 is substantially the same length as, and extends substantially parallel to, the extension parts 26A of the first divider members 18A.

In the example shown, each of the extension parts 26B of the second divider members 18B extends substantially from the joint axis 30 to substantially a mid-region of a respective one of the side walls 48.

The end wall 42, the side walls 48 and the divider members 18 define flow channels 50 therebetween. Each of the flow channels 50 has an inlet 58. Each of the flow channels 50 has a vertical flow cross sectional area 52V at a perimeter of the outlet aperture entrance 20.

Each vertical flow cross sectional area 52V is at least the size of the corresponding horizontal flow cross sectional area 52H, and desirably is greater in size.

The flow channels 50 are substantially the same or similar in size and shape.

The flow channels 50 extend laterally in pairs on two opposite sides of the joint axis 30 and are aligned and/or substantially in parallel with each other.

The outlet aperture arrangement 100 includes a connection arrangement 60 for connecting the device 10 to the cistern 14. The connection arrangement 60 defines the outlet aperture 12. The connection arrangement 60 defines a connection passage 72 therethrough, which communicates with the outlet aperture 12.

The connection arrangement 60 includes a pipe part 62 and a flange part 64. The flange part 64 extends outwardly laterally from one end of the pipe part 62.

The cistern 14 includes a cistern wall 80 which defines a cistern outlet aperture 88. The cistern wall 80 includes an internal surface 82.

The connection arrangement 60 includes a seal 68 to seal between the flange part 64 and the internal surface 82 of the cistern wall 80. The seal 68 could be in the form of a ring.

The connection arrangement 60 includes a clamp 70 to clamp the flange part 64 to the internal surface 82. The clamp 70 includes a threaded clamp ring 74. The pipe part 62 includes a threaded external surface 76.

In one example, the outlet aperture radius 56 is substantially the same size as the insertion part width 38.

In the following equations, R denotes the outlet aperture radius 56 and H denotes the height of the extension part 36.

The flow vertical cross section area 52V is given by the equation:

$$\text{Extension part height } 36\times(\text{perimeter of outlet aperture } 12)/4 = H\times 2\pi R/4$$

The horizontal flow cross sectional area 52H is given by the equation:

$$\pi R^2/4.$$

In the invention, the flow vertical cross section area 52V is at least the size of the horizontal flow cross sectional area 52H, so $$H\times 2\pi R/4 \geq \pi R^2/4 \text{ thus: } H \geq R/2$$

This relationship is true for any number of divider members.

In one example, the pipe part 62 is a 1.5 inch outside diameter BSP pipe, which has an outside diameter of 44.9 mm, a wall thickness of 1.1 mm, an internal diameter of 42.7 mm and an internal radius R of 21.35 mm.

Then, H, the extension part height 36≥10.675 mm.

The end wall 42 of the device 10 could be rectangular in plan, with the first end wall edges 44 being longer than the second end wall edges 46. The extension parts 26 could be sized accordingly, with a first pair of extension parts 26A being wider than a second pair of extension parts 26B, and the side walls 48 being the same length as the first extension parts 26A.

Figure 6:
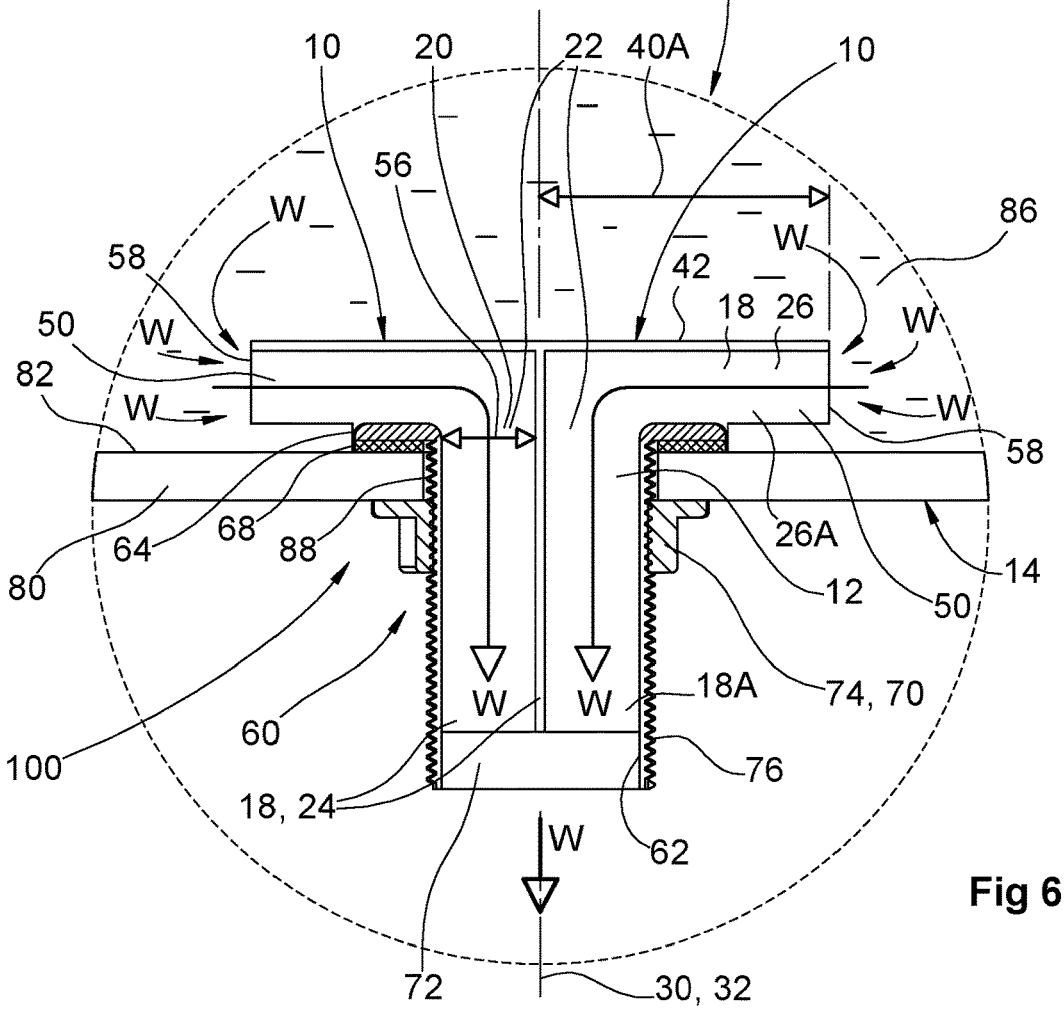
FIG. 6 is a relatively enlarged detail of part of FIG. 5 as indicated.

In the example shown in FIG. 6, R, the outlet aperture radius 56 (which is the same size as the insertion part width 38) could be 21 mm; H, the extension part height 36 could be 18 mm; the insertion part depth 34 could be 58.5 mm; and the width 40A of the first extension parts 26A could be 60 mm.

Thus, in this example:

- the ratio of the insertion part depth 34 to the extension part height 36 is 58.5:18 or 3.25:1;
- the ratio of the first extension part width 40A to the insertion part width 38 is 60:21 or 2.86:1; and
- the ratio of the extension part height 36 to the outlet aperture radius 56 is 18:21 or 0.86:1.

The device 10, the pipe part 62, the flange part 64 and the clamp ring 74 could be formed of a plastics material such as ABS and could be formed by moulding.

In Use

In use, the seal 68 is located over the pipe part 62 and against the flange part 64. The pipe part 62 is located in and through the cistern outlet aperture 88 so that the seal 68 is compressed between the flange part 64 and the internal surface 82 of the cistern wall 80.

The clamp ring 74 is mounted on the pipe part threaded external surface 76, and tightened against the cistern wall 80 to clamp the flange part 64 to the internal surface 82 so that the flange part 64 is in sealing relationship against the internal surface 82 of the cistern wall 80.

The device 10 is then located on the connection arrangement 60 so that the insertion parts 24 extend into and through the outlet aperture 12 and along the connection passage 72. The extension parts 26 locate against the flange part 64.

In use, the insertion parts 24 of each pair of divider members 18 substantially form a diameter across the outlet aperture 12 and extend substantially along the whole length of the diameter, but are sized to permit easy insertion into and removal of the insertion parts 24 from the aperture 12 and the connection passage 72.

In one example, the cistern 14 could define an internal space 84 which, in plan, has a length which is greater that its width. The device 10 could be located in the cistern space 84 so that the first divider members 18A and the side walls 48 extend along the length of the cistern space 84.

Figure 5:
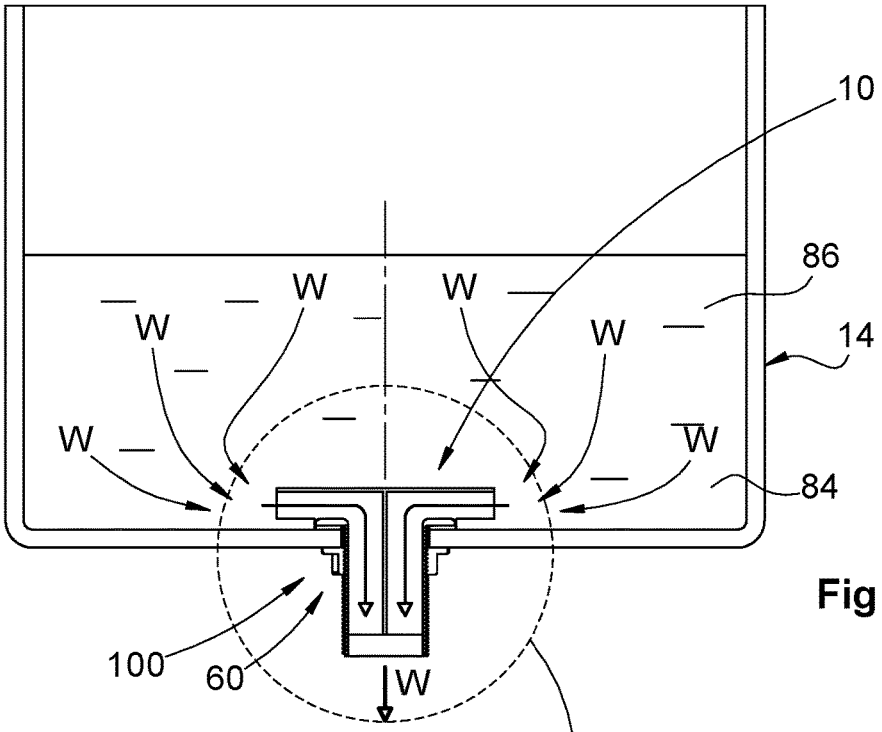
FIG. 5 is a cross-sectional view of the outlet aperture arrangement of FIG. 1 in use in a cistern.

FIGS. 5 and 6 show the cistern 14 emptying. Liquid, in this example, water 86 is flowing under gravity into and through the flow channel inlets 58, along the flow channels 50, through the vertical flow cross sectional areas 52V, through the horizontal flow cross sectional areas 52H of the outlet entrance parts 22, and through the connection passage 72, as indicated by arrows W.

In testing, the applicant has found that using the outlet aperture arrangement 100 significantly increases the average flush flow rate and thus helps improve flush effectiveness. This helps ensure that an installation meets with the required standards and could be particularly important where the cistern is close to the toilet bowl.

While the way in which the invention works is not fully known, the applicant has observed that the divider members 18 appear to reduce the formation of vortex swirls in the flow above the outlet aperture 12 in comparison with flow from the cistern 14 without the invention present, and this results in a significant increase in the average flush flow rate. The average flush flow rate is further increased by the addition of the side walls 48 or the end wall 42 and cumulatively increased by the addition of both the side walls 48 and the end wall 42.

The side walls 48 have been found to be important in providing consistent and repeatable flow paths for different cistern sizes and shapes and appear to mitigate the effect of the cistern walls on the flow paths.

Using a device 10 including the divider members 18, the side walls 48 and the end wall 42, the applicant has observed that there is no formation of vortices at the flow channel inlets 58. Rather, the water level progressively drops down the flow channel inlet 58 without vortex formation. While the reason for this is not fully understood and without wishing to be bound by any theory, the reason may be because the flow energy has been reduced by dividing the flow into a plurality of smaller flows and preventing the swirl effect. Also the intake flow into the flow channels 50 is largely horizontal rather than vertical.

Also, any turbulence or swelling of water is reduced or mitigated as the water flows through the flow channels 50. Also, water enters the flow channels 50 in a lower portion of the body of water, reducing the intake of air bubbles that can reduce the volume of water in the flow compared to conventional intakes that can create a column of water, pulling air bubbles downwards from a higher portion of the body of water.

The outlet aperture arrangement 100 is located so that during outflow of the water 86 from the cistern 14, the outlet aperture arrangement 100 is and remains wholly submerged under the water 86 for as long as possible, until the cistern 14 is substantially empty. This is achieved when the outlet aperture 12 is located in a lowermost part of the base wall 80 of the cistern 14.

The overall direction of flow of the water 86 through the outlet aperture 12 during emptying is substantially vertical.

The outlet aperture arrangement 100 is located in the cistern 14 so that the depth of the water 86 is substantially the same at each flow channel inlet 58.

Other Embodiments

Figure 4:
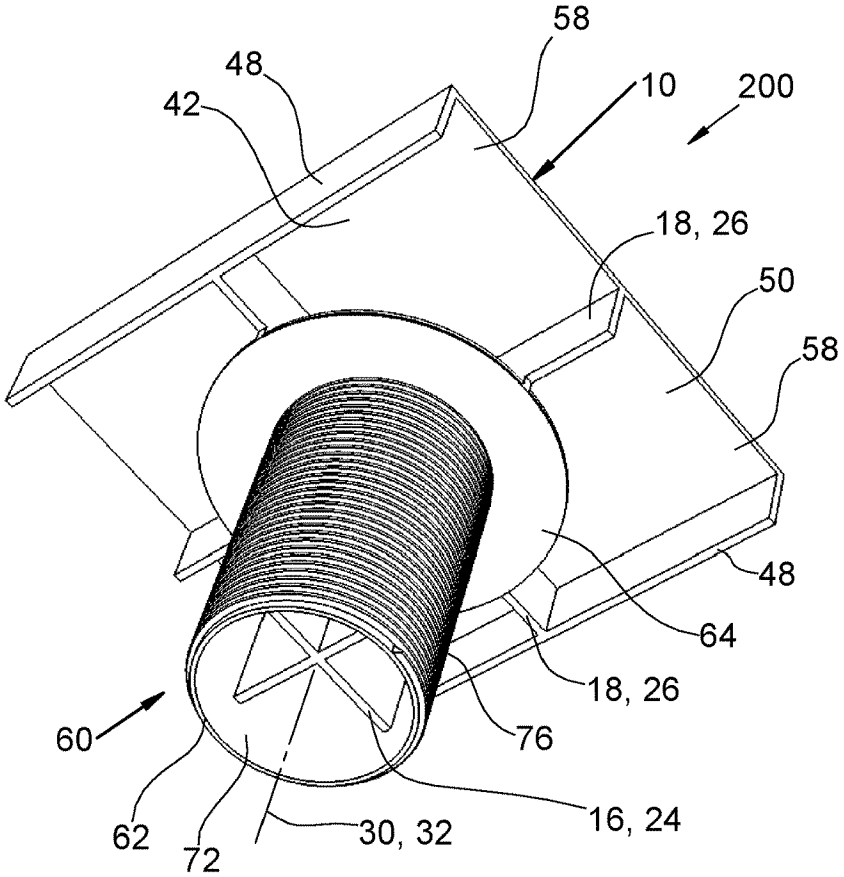
FIG. 4 is a perspective view of another outlet aperture arrangement.
Figure 3:
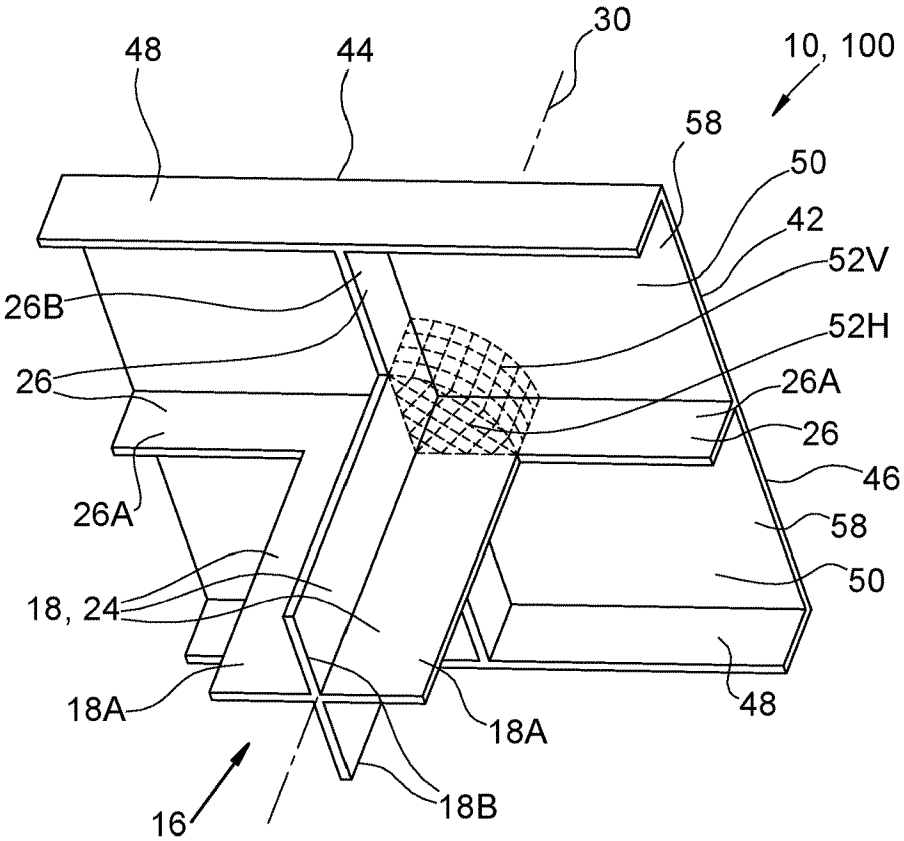
FIG. 3 is another perspective view of the device of FIG. 1 with flow cross sectional areas indicated.

FIG. 4 shows another embodiment of the invention, many features of which are similar to those already described in relation to the embodiment of FIGS. 1-3 and 5-6. Therefore, for the sake of brevity, the following embodiment will only be described in so far as it differs from the embodiment already described.

Where features are the same or similar, the same reference numerals have been used and the features will not be described again.

FIG. 4 shows another outlet aperture arrangement 200, in which the pipe part 62 and the flange part 64 of the connection arrangement 60 are formed integrally with the device 10.

The joint axis 30 could be offset from the end wall axis 78 in one plan coordinate direction (side to side or front to back) or both plan coordinate directions, to facilitate location of the device 10 in an outlet aperture 12 which is offset in the cistern 14.

Other Modifications

Various other modifications could be made without departing from the scope of the invention. The outlet aperture arrangement, the connection arrangement and the device could be of any suitable size and shape, and could be formed of any suitable material (within the scope of the specific definitions herein).

In one example, the outlet aperture arrangement 100, 200 could include a mounting (not shown) for a tiltably mounted container (not shown) such as that disclosed in GB 2532998 B.

In another example, the end wall 42 could define a formation aperture (not shown) to aid manufacture. The outlet aperture arrangement could include an aperture cover member (not shown), which in use locates in or over the formation aperture to substantially prevent or impede fluid flow therethrough.

The container in which the outlet aperture arrangement is located could be any type of container and could contain any type of liquid.

Any of the features or steps of any of the embodiments shown or described could be combined in any suitable way, within the scope of the overall disclosure of this document.

There are thus provided outlet aperture arrangements with a number of advantages over conventional arrangements. In particular, the outlet aperture arrangements disclosed herein increase the average flush flow rate, which helps improve flush effectiveness.

The invention claimed is:

1. An outlet aperture arrangement including a flow promotion device located at an outlet aperture of a liquid container, the device comprising: a divider arrangement, the divider arrangement including one or more divider members, wherein, in use, the divider arrangement is located at or in an entrance to the outlet aperture so that the or each divider member divides the entrance into a plurality of outlet entrance parts, wherein the or each divider member comprises an insertion part which extends into and through the outlet aperture, wherein the or each divider member includes an extension part which extends upwardly outwardly from the entrance, wherein the or each or some or all of the extension parts extend laterally outwardly beyond the outlet aperture.

2. The arrangement according to claim 1, in which each outlet entrance part comprises a horizontal flow cross sectional area, and in which the horizontal flow cross sectional areas of the outlet entrance parts are of substantially equal size.

3. The arrangement according to claim 1, wherein the liquid container is a toilet cistern containing water for flushing through a toilet bowl, and wherein the outlet aperture arrangement is a toilet cistern outlet arrangement.

4. The arrangement according to claim 1, in which the or each divider member is substantially planar and includes one insertion part and one extension part.

5. The arrangement according to claim 1, in which the divider arrangement includes a plurality of divider members, which are joined together along a common joint, which extends along a joint axis; in which the aperture has an axis which extends through a midpoint thereof; and wherein, in use, the joint axis is coaxial with the aperture axis.

6. The arrangement according to claim 1, in which the divider members are joined together along a common joint and extend from the common joint at a regular radial angle spacing.

7. The arrangement according to claim 1, in which the divider arrangement comprises four divider members which extend from a common joint at a regular radial angle spacing which is substantially 90°; the divider members are arranged in pairs, with the members of each pair being aligned with each other; the pairs comprise a pair of first divider members and a pair of second divider members.

8. The arrangement according to claim 1, in which the divider members are arranged in pairs, in use, the insertion parts of each pair of divider members substantially form a diameter across the outlet aperture.

9. The arrangement according to claim 1, in which divider arrangement includes a plurality of divider members, which are joined together along a common joint, which extends along a joint axis; the or each insertion part has a depth along the joint axis; the or each extension part has a height along the joint axis; and in which the ratio of the insertion part depth to the extension part height is between 2:1 and 4.5:1.

10. The arrangement according to claim 1, in which the divider arrangement includes a plurality of divider members, which are joined together along a common joint, which extends along a joint axis, the outlet aperture is circular and has a radius; the or each extension part has a height along the joint axis; and in which the ratio of the extension part height to the outlet aperture radius is between 0.48:1 and 1.24:1.

11. The arrangement according to claim 10, in which the ratio of the extension part height to the outlet aperture radius is between 0.71:1 and 1.00:1.

12. The arrangement according to claim 1, in which the divider arrangement includes a plurality of divider members, which are joined together along a common joint, which extends along a joint axis, the or each insertion part has a width normal to the joint axis; the or each extension part has a width normal to the joint axis; and in which the ratio of the extension part width to the insertion part width is between 2.11:1 and 3.51:1.

13. The arrangement according to claim 12, in which the ratio of the extension part width to the insertion part width is between 2.58:1 and 3.04:1.

14. The arrangement according to claim 1, in which the device includes an end wall, which is substantially solid and supported by the or some or each of the extension parts; in which the end wall extends above, and is joined to the or some or each of the extension parts.

15. The arrangement according to claim 14, in which the divider arrangement includes a plurality of divider members, which are jointed together along a common joint, which extends along a joint axis, the or each of the extension parts extends substantially from the joint axis to substantially a midpoint of one of the end wall edges.

16. The arrangement according to claim 14, in which the divider arrangement includes a plurality of divider members, which are joined together along a common joint, which extends along a joint axis, the or each of the extension parts extends substantially from the joint axis to substantially a midpoint of one of the end wall edges; the device includes only one pair of substantially parallel side walls; each side wall is substantially solid; each side wall is joined to a different one of the first edges; the side walls extend substantially parallel to the first divider members and each side wall is substantially the same length as, and extends substantially parallel to, the extension parts of the first divider members.

17. The arrangement according to claim 1, in which the divider members are arranged in pairs, with the members of each pair being aligned with each other; the pairs comprise a pair of first divider members and a pair of second divider members, the device includes an end wall, the end wall is rectangular in plan and comprises a pair of substantially parallel first edges and a pair of substantially parallel second edges; and in which the first end wall edges extend substantially in parallel with the first divider members.

18. The arrangement according to claim 1, in which the divider members are arranged in pairs, with the members of each pair being aligned with each other; the pairs comprise a pair of first divider members and a pair of second divider members; the device includes an end wall, the end wall is rectangular in plan and comprises a pair of substantially parallel first edges and a pair of substantially parallel second edges; and in which the first end wall edges extend substantially in parallel with the first divider members, the device includes only one pair of substantially parallel side walls; each side wall is substantially solid; each side wall is joined to a different one of the first edges; the end wall extends between the side walls; the end wall, the side walls and the divider members define flow channels therebetween; each of the flow channels has an inlet; each of the flow channels has a vertical flow cross sectional area at a perimeter of the outlet aperture entrance; each outlet entrance part comprises a horizontal flow cross sectional area; and each vertical flow cross sectional area is at least the size of the horizontal flow cross sectional area of the corresponding outlet entrance part.

19. The arrangement according to claim 1, in which the divider members are arranged in pairs, with the members of each pair being aligned with each other; the pairs comprise a pair of first divider members and a pair of second divider members, the device includes an end wall, the end wall is rectangular in plan and comprises a pair of substantially parallel first edges and a pair of substantially parallel second edges; and in which the first end wall edges extend substantially in parallel with the first divider members, the device includes only one pair of substantially parallel side walls; each side wall is substantially solid; each side wall is joined to a different one of the first edges; the end wall extends between the side walls; the end wall, the side walls and the divider members define flow channels therebetween; each of the flow channels has an inlet; each of the flow channels has a vertical flow cross sectional area at a perimeter of the outlet aperture entrance; each outlet entrance part comprises a horizontal flow cross sectional area; and each vertical flow cross sectional area is at least the size of the horizontal flow cross sectional area of the corresponding outlet entrance part, the flow channels extend laterally in pairs on two opposite sides of the joint axis; are aligned or in parallel with each other; and are substantially the same size and shape.

20. The arrangement according to claim 1, in which the outlet aperture arrangement includes a connection arrangement for connecting the device to the container; and the connection arrangement defines the outlet aperture.

* * * * *